US007215077B2

(12) United States Patent
Kawamura et al.

(10) Patent No.: US 7,215,077 B2
(45) Date of Patent: May 8, 2007

(54) PLASMA DISPLAY APPARATUS AND FLUORESCENT MATERIAL FOR PLASMA DISPLAY PANEL

(75) Inventors: Hiroshi Kawamura, Tokyo (JP); Nobumitsu Aibara, Tokyo (JP)

(73) Assignee: Pioneer Corporation, Tokyo (JP)

( * ) Notice: Subject to any disclaimer, the term of this patent is extended or adjusted under 35 U.S.C. 154(b) by 335 days.

(21) Appl. No.: 10/864,547

(22) Filed: Jun. 10, 2004

(65) Prior Publication Data

US 2004/0251833 A1 Dec. 16, 2004

(30) Foreign Application Priority Data

Jun. 12, 2003 (JP) ..... 2003-167955

(51) Int. Cl.
*H01J 17/49* (2006.01)

(52) U.S. Cl. ..... 313/582; 252/301.4 R; 252/301.4 P; 252/301.6 P; 313/584; 313/585; 313/586; 313/587

(58) Field of Classification Search ..... 313/582–587; 252/301.4 R, 301.4 P, 301.6 P
See application file for complete search history.

(56) References Cited

U.S. PATENT DOCUMENTS 6,168,731 B1 * 1/2001 Hampden-Smith et al. ..... 252/301.4 S

FOREIGN PATENT DOCUMENTS

JP 08293262 A * 11/1996
JP 2002-3835 A 1/2002
JP 2003-34786 A 2/2003

* cited by examiner

*Primary Examiner*—Joseph Williams
*Assistant Examiner*—Hana A. Sanei
(74) *Attorney, Agent, or Firm*—Sughrue Mion, PLLC

(57) ABSTRACT

Fluorescent material used for a plasma display panel contains particles having various diameters wherein X1/Y is equal to or smaller than 10% where X1 indicates a number of particles having a diameter equal to or smaller than 1.0 micrometers, and Y indicates a total number of particles contained in the fluorescent material.

18 Claims, 15 Drawing Sheets

X1 : NUMBER OF PARTICLES HAVING A DIAMETER EQUAL TO OR SMALLER THAN 1.0 μm
Y : TOTAL NUMBER OF PARTICLES

X2 : NUMBER OF PARTICLES HAVING A DIAMETER EQUAL TO OR GREATER THAN 16.0 μm
Y : TOTAL NUMBER OF PARTICLES

T1 : LOCALLY MAXIMUM THICKNESS
T2 : AVERAGE THICKNESS

X1 : NUMBER OF PARTICLES HAVING A DIAMETER EQUAL TO OR SMALLER THAN 1.0 μm
Y : TOTAL NUMBER OF PARTICLES

X2 : NUMBER OF PARTICLES HAVING A DIAMETER EQUAL TO OR GREATER THAN 16.0 μm
Y : TOTAL NUMBER OF PARTICLES

X1 : NUMBER OF PARTICLES HAVING A DIAMETER EQUAL TO OR SMALLER THAN 1.0 μm
Y : TOTAL NUMBER OF PARTICLES

X2 : NUMBER OF PARTICLES HAVING A DIAMETER EQUAL TO OR GREATER THAN 16.0 μm

Y : TOTAL NUMBER OF PARTICLES

PLASMA DISPLAY APPARATUS AND FLUORESCENT MATERIAL FOR PLASMA DISPLAY PANEL

BACKGROUND OF THE INVENTION

1 Field of the Invention

The invention relates to a plasma display apparatus, and more particularly to fluorescent material coated onto a fluorescent layer which is a part of the plasma display apparatus.

2 Description of the Related Art

First, hereinbelow is explained a structure of a conventional plasma display panel.

FIG. 1 is an exploded perspective view of a conventional plasma display panel.

A plasma display panel 15 is comprised of an electrically insulating front substrate 1A, and an electrically insulating rear substrate 1B facing the front substrate 1A.

The front substrate 1A is formed on a surface facing the rear substrate 1B with a scanning electrode 9 and a common electrode 10 spaced away from each other by a certain distance and extending in parallel with each other.

Each of the scanning electrode 9 and the common electrode 10 is comprised of a bus electrode 13 providing electrical conductivity, and a primary discharge electrode 2 formed on the bus electrode 3 and causing electric discharge. The primary discharge electrode 2 is composed of ITO (Indium-Tin Oxide) or $SnO_2$ for preventing reduction in light-transmittance.

A dielectric layer 4A is formed on the front substrate 1A, covering the scanning electrode 9 and the common electrode 10 therewith. The dielectric layer 4A is covered with a protection layer 5 for protecting the dielectric layer 4A from electric discharges. The protection layer 5 is composed of magnesium oxide (MgO), for instance.

The rear substrate 1B is formed on a surface facing the front substrate 1A with a plurality of data electrodes 6 extending in a direction perpendicular to a direction in which the scanning electrode 9 and the common electrode 10 extend. The data electrodes 6 are equally spaced away from one another, and extend in parallel with one another.

A dielectric layer 4B is formed on the rear substrate 1B, covering the data electrodes 6 therewith. On the dielectric layer 4B is formed a plurality of partition walls 7 extending in parallel with the data electrodes 6. The partition walls 7 define a discharge space between the first and second substrates 1A and 1B, and the partition walls 7 located adjacent to each other define a cell therebetween.

Fluorescent material 8 is coated on sidewalls of the partition walls 7 and an exposed surface of the dielectric layer 4B. The fluorescent material 8 converts ultra-violet rays generated by discharges, into visible lights. For instance, red, green and blue (RGB) fluorescent materials are coated every three cells, ensuring displaying color images.

Discharge gas spaces sandwiched between the front and rear substrates 1A and 1B and further between adjacent partition walls 7 are filled with discharge gas comprised of helium, neon or xenon alone or in combination, for instance.

In operation, voltages each having a predetermined waveform are applied to the scanning electrode 9, the common electrode 10 and the data electrodes 6. When a voltage difference between the scanning electrode 9 and the common electrode 10 or a voltage difference between the common electrode 10 and the data electrodes 7 is over a threshold voltage, discharge is generated between the scanning electrode 9 and the common electrode 10 and between the common electrode 10 and the data electrodes 7, respectively, and accordingly, the fluorescent material 8 emits visible lights.

There have been suggested many fluorescent materials used for a plasma display panel.

For instance, Japanese Patent Application Publication No. 2002-3835 has suggested inorganic fluorescent material in which A/B is equal to or greater than 30% where A indicates a weight of particles having a diameter of 1.0 or 0.8 micrometers or smaller, and B indicates a weight of all of particles.

Japanese Patent Application Publication No. 2003-34786 has suggested spherical fluorescent material having an average diameter of 0.1 to 2.0 micrometers and a maximum diameter of 7.0 micrometers or smaller.

The inorganic fluorescent material suggested in the firstly mentioned Publication contains minute particles having a diameter of 1.0 or 0.8 micrometers or smaller by 30 weight % or greater. As a result, particles tend to be aggregated.

If particles are aggregated, the fluorescent material would have a locally increased thickness, resulting in that a voltage for generating writing-discharge is locally increased. For instance, if the fluorescent material has different thicknesses in cells, a voltage increase would occur only in cells having thick fluorescent material, and hence, display quality is degraded in the cells. Thus, uniformity in displaying images in a region in which cells are arranged, that is, a display region is not achieved.

In the secondly mentioned Publication, spherical particles are used, and the fluorescent material is designed to contain small particles much more than large particles in a particle-diameter profile for raising an arrangement density of the fluorescent material, and further for enhancing a brightness.

However, the fluorescent material suggested in the secondly mentioned Publication contain much minute particles having a diameter of 1.0 micrometer or smaller. That is, particles contained in the fluorescent material are minute on the whole. Hence, similarly to the inorganic fluorescent material suggested in the firstly mentioned Publication, the particles tend to be aggregated.

If particles are aggregated, the fluorescent material would have a locally increased thickness, resulting in that a voltage for generating writing-discharge is locally increased, similarly to the firstly mentioned Publication. Thus, uniformity in displaying images in a display region is not achieved.

SUMMARY OF THE INVENTION

In view of the above-mentioned problems in the conventional fluorescent material in a plasma display apparatus, it is an object of the present invention to provide fluorescent material which is capable of preventing a local increase in a voltage for generating a writing-discharge.

It is also an object of the present invention to provide a plasma display apparatus including the above-mentioned fluorescent material.

In one aspect of the present invention, there is provided fluorescent material used for a plasma display panel, the fluorescent material containing particles having various diameters wherein X1/Y is equal to or smaller than 10% where X1 indicates a number of particles having a diameter equal to or smaller than 1.0 micrometers, and Y indicates a total number of particles contained in the fluorescent material.

It is preferable that X2/Y is equal to or smaller than 2% where X2 indicates a number of particles having a diameter equal to or greater than 16 micrometers.

It is preferable that X2/Y is equal to or smaller than 1% where X2 indicates a number of particles having a diameter equal to or greater than 16 micrometers.

It is preferable that T1/T2 is equal to or smaller than 1.7 where T1 indicates a locally maximum thickness of the fluorescent material, and T2 indicates an average thickness of the fluorescent material.

It is preferable that T1/T2 is equal to or smaller than 1.5 where T1 indicates a locally maximum thickness of the fluorescent material, and T2 indicates an average thickness of the fluorescent material.

There is further provided fluorescent material used for a plasma display panel, the fluorescent material containing particles having various diameters wherein X1/Y is equal to or smaller than 1% where X1 indicates a number of particles having a diameter equal to or smaller than 1.0 micrometers, and Y indicates a total number of particles contained in the fluorescent material.

In another aspect of the present invention, there is provided a plasma display apparatus comprising a first substrate, a second substrate and the above-mentioned fluorescent material arranged between the first and second substrates, wherein electric discharge is caused in a discharge cell formed between the first and second substrates to excite the fluorescent material to emit a light.

The plasma display apparatus may be designed to further include a light-reflection layer.

The greater a diameter of particles constituting fluorescent material is, the lower a brightness is. However, a light-reflection layer prevents reduction in a brightness.

In a plasma display apparatus including a light-reflection layer, fluorescent material is coated on the light-reflection layer. It is preferable that a light-reflection layer includes white pigment powder. A light-reflection layer including white pigment therein would have white hue or would be almost white in color, ensuring enhanced reflection-ability.

The advantages obtained by the aforementioned present invention will be described hereinbelow.

In accordance with the present invention, the fluorescent material used in a plasma display panel is designed to have a predetermined particle-diameter profile to thereby prevent aggregation of minute particles and a local increase in a thickness caused by large particles. As a result, it is possible to prevent a local increase in a voltage for generating a writing-voltage, and stabilize the voltage.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

[First Embodiment]

The fluorescent material in accordance with the first embodiment emits green light.

As fluorescent material which emits green light, there may be selected $Zn_2SiO_4$:Mn, (Y, Gd)$BO_3$:Tb or $YBO_3$:Tb, for instance.

Figure 2:
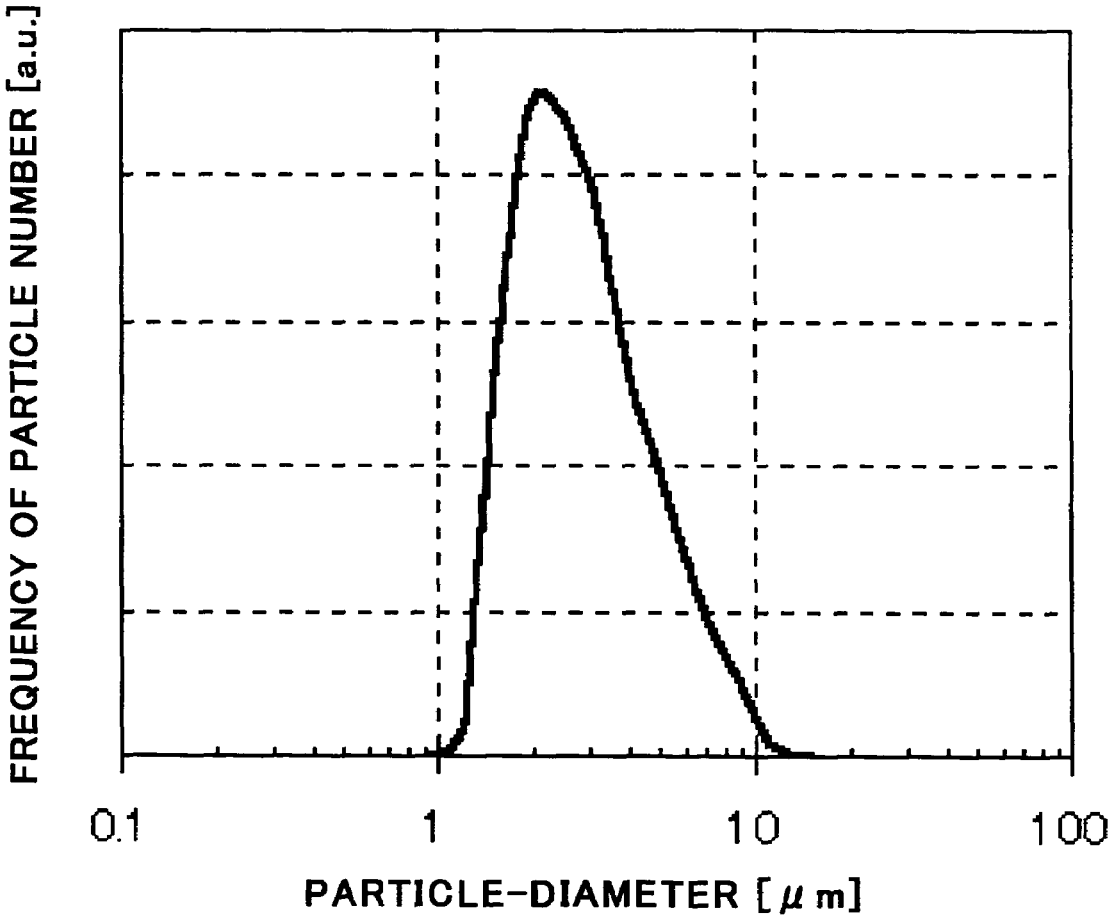
FIG. 2 is a histogram showing a particle-diameter profile of the fluorescent material from which green light emits, in accordance with the first embodiment of the present invention.
Figure 3:
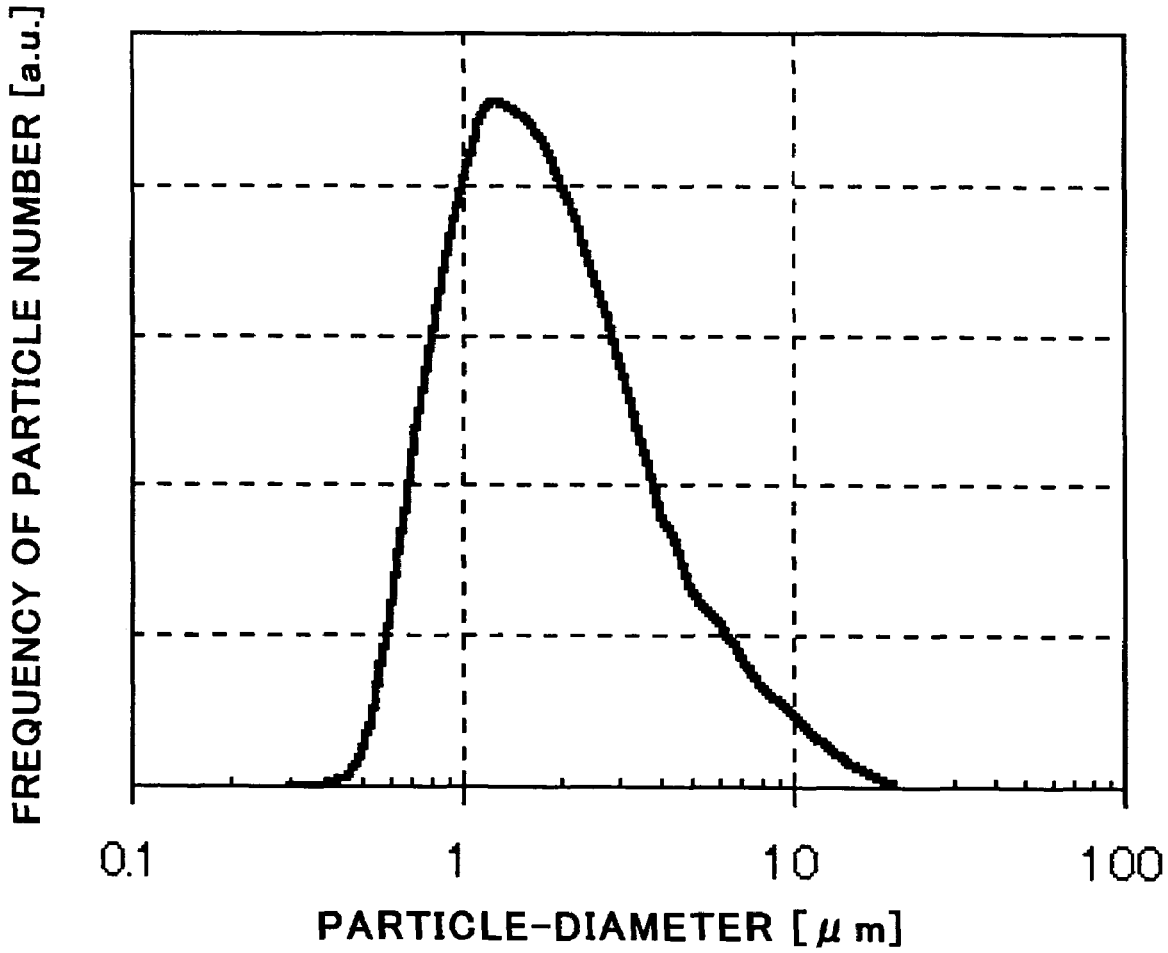
FIG.3 PRIOR ART
FIG. 3 is a histogram showing a particle-diameter profile of conventional fluorescent material from which green light emits.

FIG. 2 is a histogram showing a particle-diameter profile of the fluorescent material in accordance with the first embodiment of the present invention, and FIG. 3 is a histogram showing a particle-diameter profile of conventional fluorescent material from which green light emits. In FIGS. 2 and 3, the axis of abscissa indicates a particle diameter in a unit of micrometer [μm], and the axis of ordinates indicates a frequency of a number of particles in an arbitrary unit [a.u.].

As is obvious in comparison of FIGS. 2 and 3 with each other, a particle-diameter profile of the fluorescent material in accordance with the first embodiment is narrower than the same of conventional fluorescent material.

Figure 4:
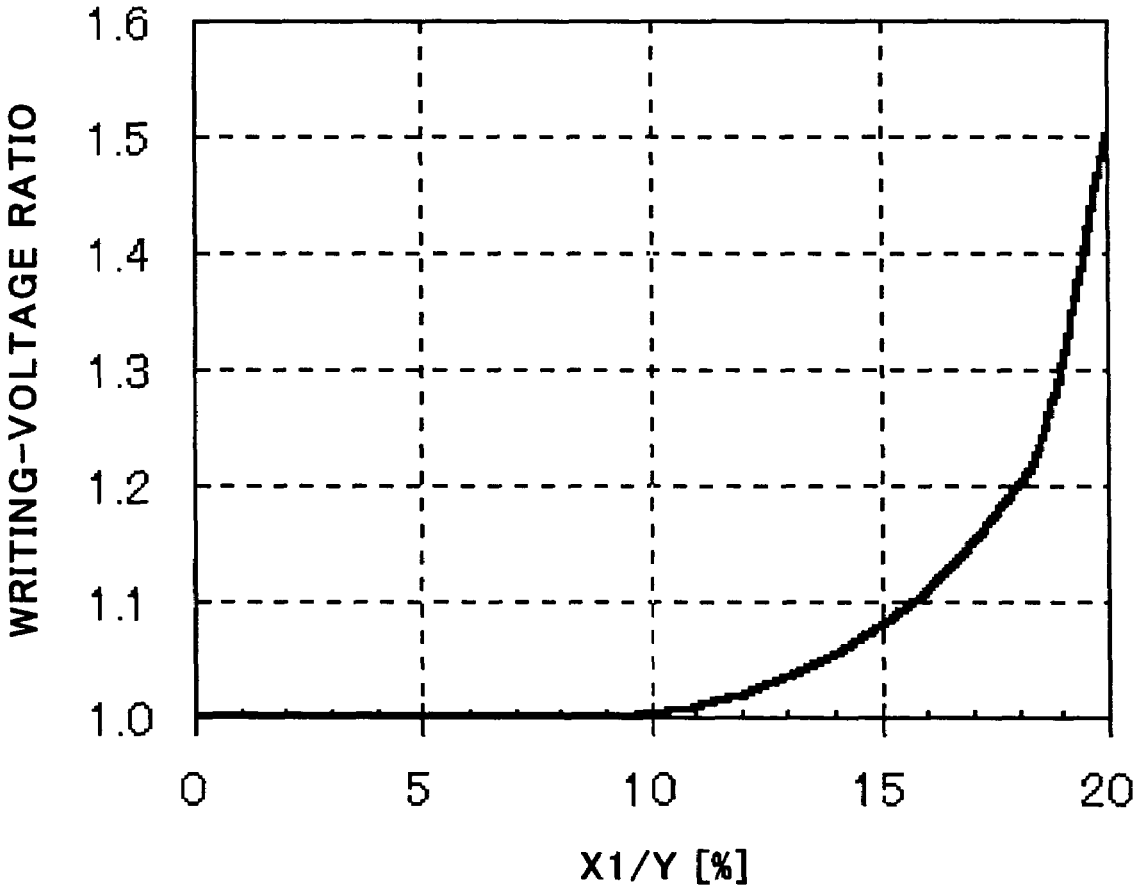
FIG. 4 is a graph showing a relation between a writing-voltage ratio and a ratio defined as X1/Y in the fluorescent material from which green light emits, in accordance with the first embodiment of the present invention, wherein X1 indicates a number of particles having a diameter equal to or smaller than 1.0 micrometers, and Y indicates a total number of particles contained in the fluorescent material.

FIG. 4 is a graph showing a relation between a writing-voltage ratio and a ratio defined as X1/Y [%] in the fluorescent material in accordance with the first embodiment of the present invention, wherein X1 indicates a number of particles having a diameter equal to or smaller than 1.0 micrometers, and Y indicates a total number of particles contained in the fluorescent material.

A writing-voltage ratio is defined in accordance with the following equation (A).

$$\text{Writing-voltage ratio} = (\text{Actual writing-voltage})/(\text{average writing-voltage}) \quad (A)$$

Specifically, a writing-voltage ratio indicates how much variance an actual writing-voltage has in comparison with an average writing-voltage. Accordingly, if a writing-voltage ratio is equal to 1.0 (a bottom of the axis of ordinates in FIG. 4), an actual writing-voltage is equal to an average writing-voltage, and hence, there is no variance in an actual writing-voltage.

As illustrated in FIG. 4, a writing-voltage ratio is equal to 1.0 when the ratio X1/Y is equal to or smaller than 10%. That is, there is no variance in an actual writing-voltage. In contrast, when the ratio X1/Y becomes over about 11%, a writing-voltage ratio starts increasing. That is, variance begins to occur in an actual writing-voltage. For instance, when the ratio X1/Y is equal to 20%, a writing-voltage ratio rises up to 1.5.

Accordingly, if the ratio X1/Y is equal to or smaller than 10% which is smaller than 11%, there occurs no variance in an actual writing-voltage.

Hence, the fluorescent material from which green light emits, in accordance with the first embodiment, is designed to have the ratio X1/Y equal to or smaller than 10%.

Furthermore, as is obvious in view of FIG. 4, if the ratio X1/Y is equal to or smaller than 1%, there is absolutely no variance in an actual writing-voltage. Accordingly, it is possible to completely prevent variance in an actual writing-voltage by designing the ratio X1/Y to be equal to or smaller than 1% in the fluorescent material in accordance with the first embodiment.

Figure 5:
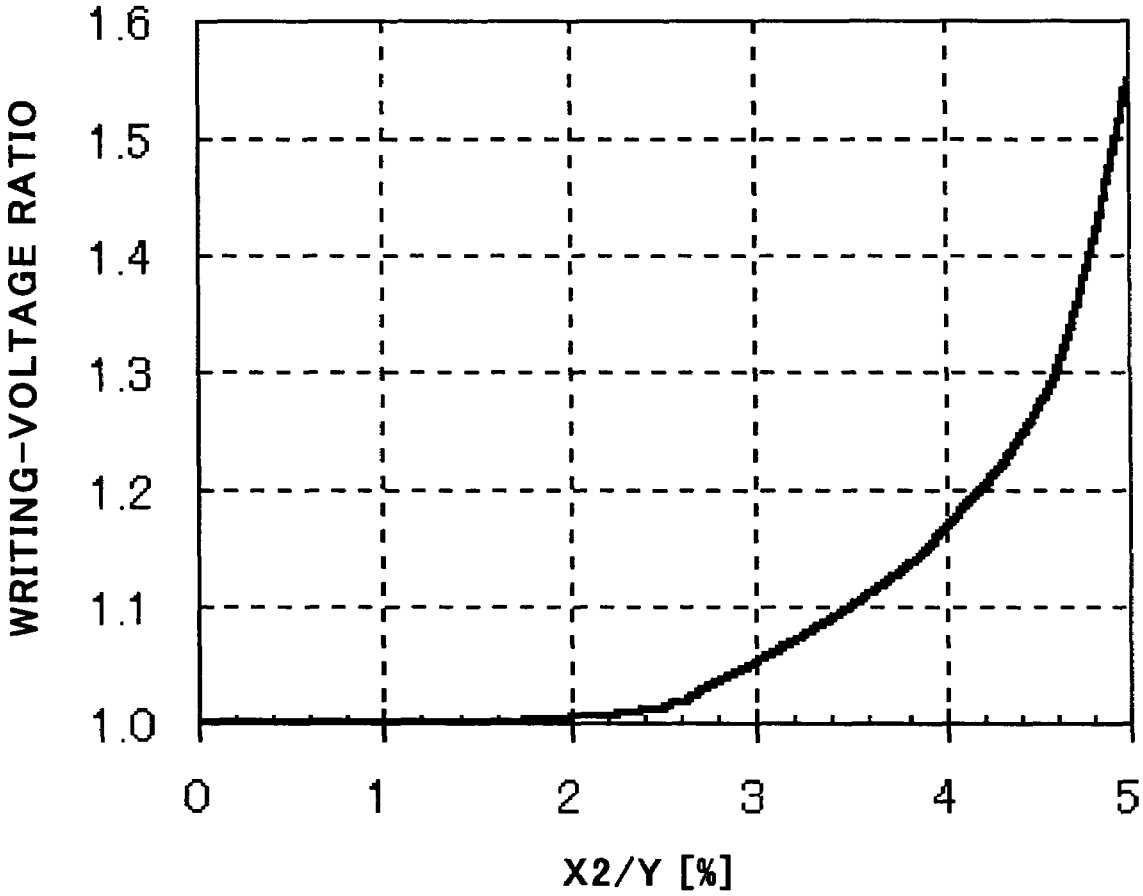
FIG. 5 is a graph showing a relation between a writing-voltage ratio and a ratio defined as X2/Y in the fluorescent material from which green light emits, in accordance with the first embodiment of the present invention, wherein X2 indicates a number of particles having a diameter equal to or greater than 16.0 micrometers, and Y indicates a total number of particles contained in the fluorescent material.

FIG. 5 is a graph showing a relation between a writing-voltage ratio and a ratio defined as X2/Y in the fluorescent material in accordance with the first embodiment, wherein X2 indicates a number of particles having a diameter equal to or greater than 16.0 micrometers, and Y indicates a total number of particles contained in the fluorescent material.

A writing-voltage ratio is defined in accordance with the above-mentioned equation (A).

As illustrated in FIG. 5, a writing-voltage ratio is equal to 1.0 when the ratio X2/Y is equal to or smaller than 2.0%. That is, there is no variance in an actual writing-voltage. In contrast, when the ratio X2/Y becomes over about 2.2%, a writing-voltage ratio starts rising. That is, variance begins to occur in an actual writing-voltage. For instance, when the ratio X1/Y is equal to 5%, a writing-voltage ratio rises up to 1.55.

Accordingly, if the ratio X2/Y is equal to or smaller than 2% which is smaller than 2.2%, there occurs no variance in an actual writing-voltage.

Hence, the fluorescent material from which green light emits, in accordance with the first embodiment, is designed to have the ratio X2/Y equal to or smaller than 2%.

Furthermore, as is obvious in view of FIG. 5, if the ratio X2/Y is equal to or smaller than 1%, there is absolutely no variance in an actual writing-voltage. Accordingly, it is possible to completely prevent variance in an actual writing-voltage by designing the ratio X2/Y to be equal to or smaller than 1% in the fluorescent material in accordance with the first embodiment.

Figure 6:
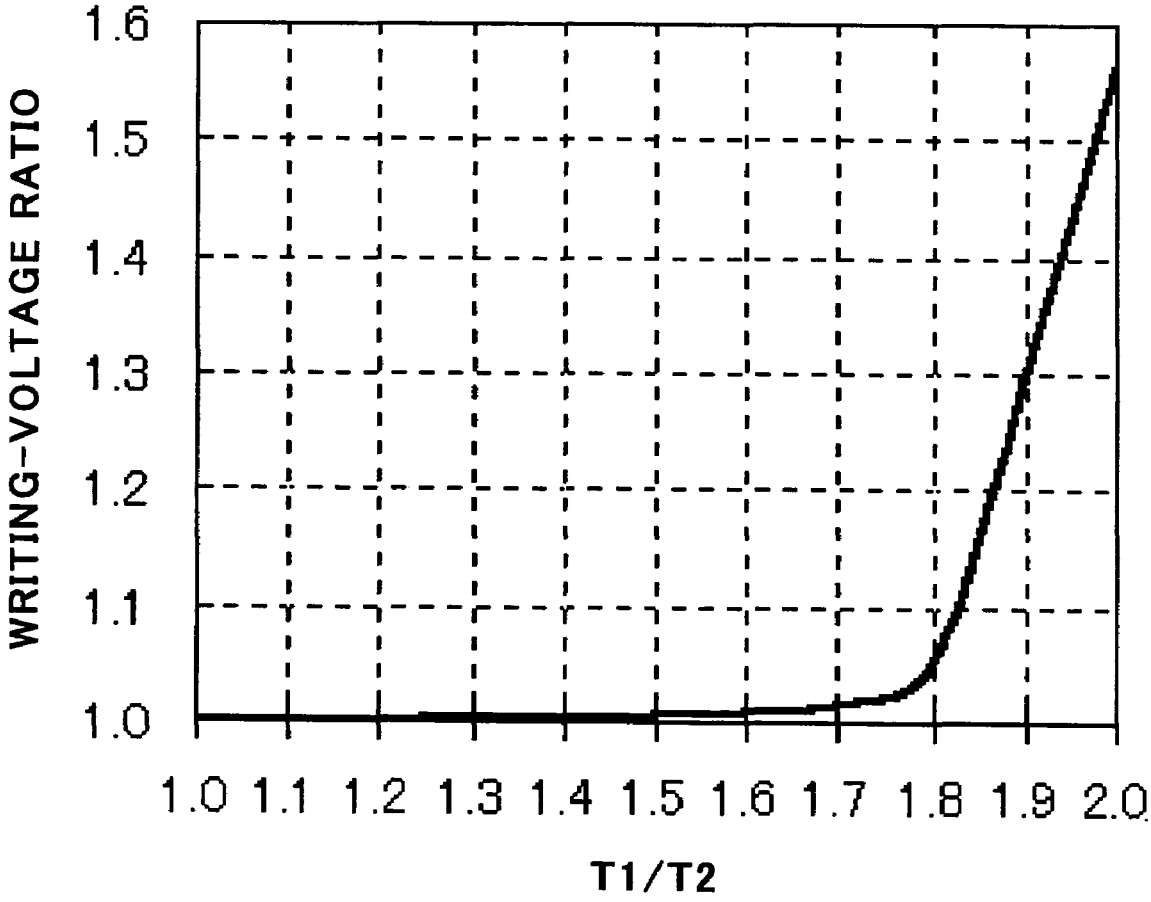
FIG. 6 is a graph showing a relation between a writing-voltage ratio and a ratio defined as T1/T2 in the fluorescent material from which green light emits, in accordance with the first embodiment of the present invention, wherein T1 indicates a locally maximum thickness of the fluorescent material, and T2 indicates an average thickness of the fluorescent material.

FIG. 6 is a graph showing a relation between a writing-voltage ratio and a ratio defined as T1/T2 in the fluorescent material in accordance with the first embodiment, wherein T1 indicates a locally maximum thickness of the fluorescent material, and T2 indicates an average thickness of the fluorescent material.

A writing-voltage ratio is defined in accordance with the above-mentioned equation (A).

In general, fluorescent material does not have a uniform thickness. Fluorescent material might have a locally increased thickness or thicknesses where large particles exist. A locally maximum thickness indicates a maximum thickness among such locally increased thicknesses.

As illustrated in FIG. 6, a writing-voltage ratio is equal to 1.0 when the ratio T1/T2 is equal to or smaller than 1.5. That is, there is no variance in an actual writing-voltage. In contrast, when the ratio T1/T2 becomes over about 1.6, a writing-voltage ratio starts rising in a small rate. If the ratio T1/T2 is over about 1.8, a writing-voltage ratio rises in a high rate. That is, much variance begins to occur in an actual writing-voltage, if the T1/T2 ratio is over about 1.8. For instance, when the ratio T1/T2 is equal to 2.0, a writing-voltage ratio rises up to 1.55.

Accordingly, if the ratio T1/T2 is equal to or smaller than 1.7 which is smaller than 1.8, even if there occurs variance in an actual writing-voltage, it would be possible to suppress the variance within a quite small range.

Hence, the fluorescent material from which green light emits, in accordance with the first embodiment, is designed to have the ratio T1/T2 equal to or smaller than 1.7.

Furthermore, as is obvious in view of FIG. 6, if the ratio T1/T2 is equal to or smaller than 1.5, there is absolutely no variance in an actual writing-voltage. Accordingly, it is possible to completely prevent variance in an actual writing-voltage by designing the ratio T1/T2 to be equal to or smaller than 1.5 in the fluorescent material in accordance with the first embodiment.

As mentioned above, the fluorescent material from which green light emits, in accordance with the first embodiment, is designed to have (a) the X1/Y ratio equal to or smaller than 10%, preferably, 1%, (b) the X2/Y ratio equal to or smaller than 2%, preferably, 1%, and (c) the T1/T2 ratio equal to or smaller than 1.7, preferably, 1.5.

As a result, it is possible to prevent variance in an actual writing-voltage relative to an average writing-voltage, and hence, prevent local increase in a voltage necessary for generating writing-discharges. Thus, it is possible to prevent deterioration in quality in displaying images in a plasma display apparatus including the fluorescent material in accordance with the first embodiment.

[Second Embodiment]

The fluorescent material in accordance with the second embodiment emits blue light.

As fluorescent material which emits blue light, there may be selected $BaMgAl_{10}O_{17}$:Eu, for instance.

Figure 7:
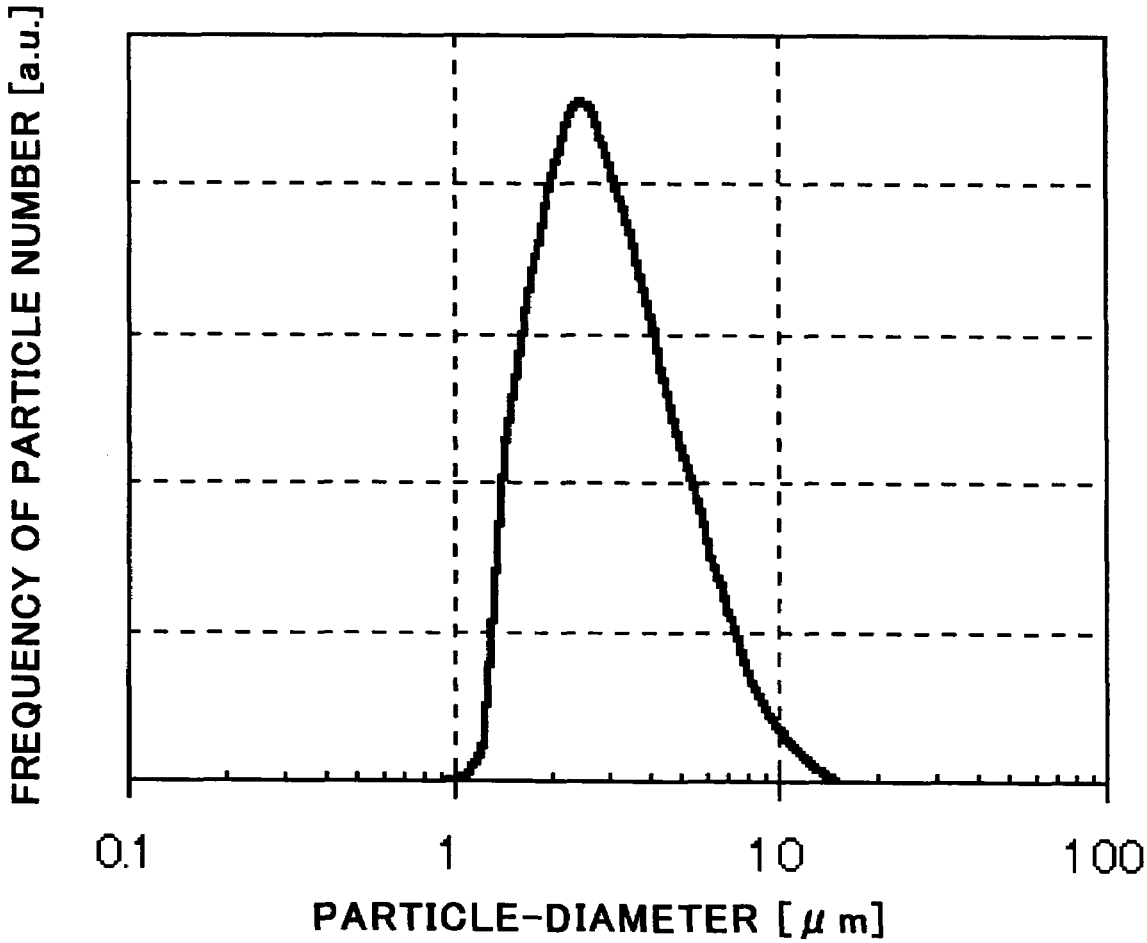
FIG. 7 is a histogram showing a particle-diameter profile of the fluorescent material from which blue light emits, in accordance with the second embodiment of the present invention.
Figure 8:
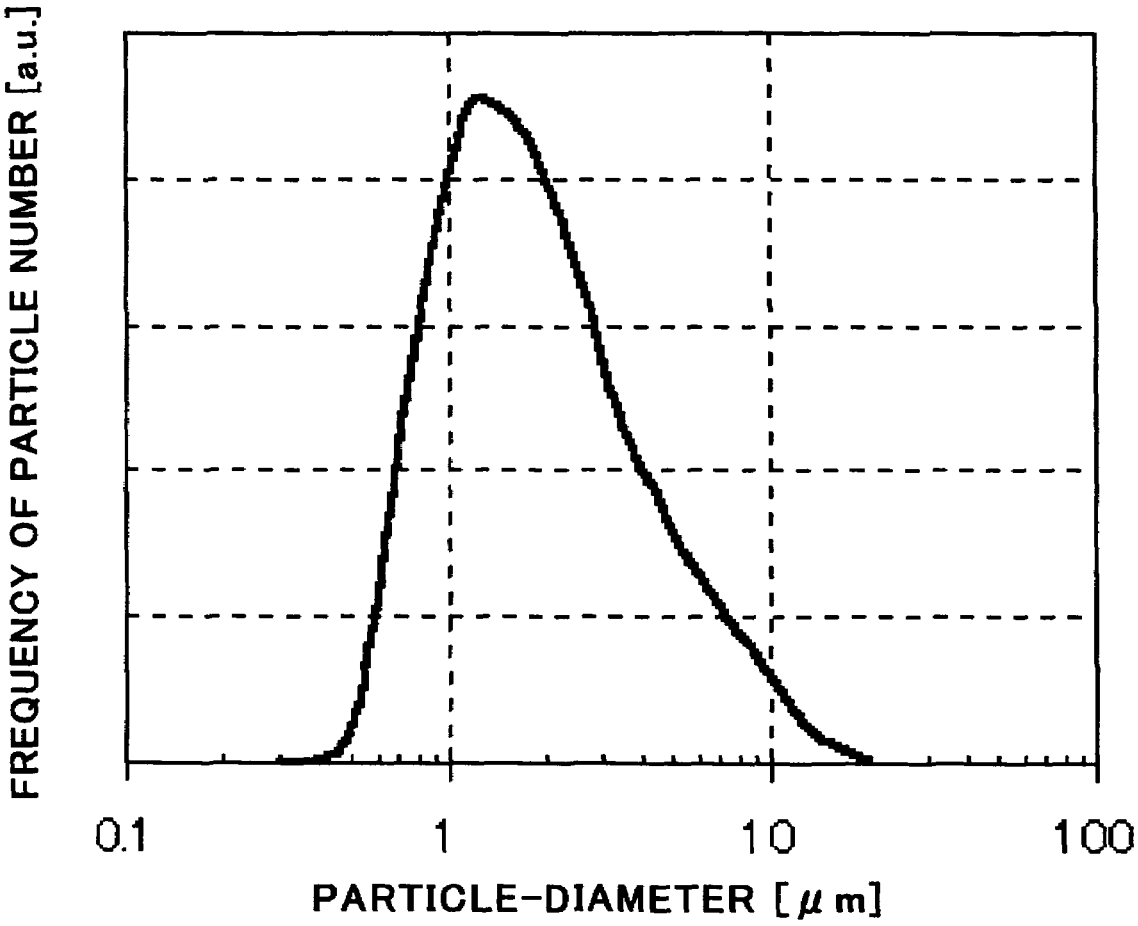
FIG.8 PRIOR ART
FIG. 8 is a histogram showing a particle-diameter profile of conventional fluorescent material from which blue light emits.

FIG. 7 is a histogram showing a particle-diameter profile of the fluorescent material in accordance with the second embodiment of the present invention, and FIG. 8 is a histogram showing a particle-diameter profile of conventional fluorescent material from which blue light emits. In FIGS. 7 and 8, the axis of abscissa indicates a particle diameter in a unit of micrometer [μm], and the axis of ordinates indicates a frequency of a number of particles in an arbitrary unit [a.u.].

As is obvious in comparison of FIGS. 7 and 8 with each other, a particle-diameter profile of the fluorescent material in accordance with the second embodiment is narrower than the same of conventional fluorescent material.

Figure 9:
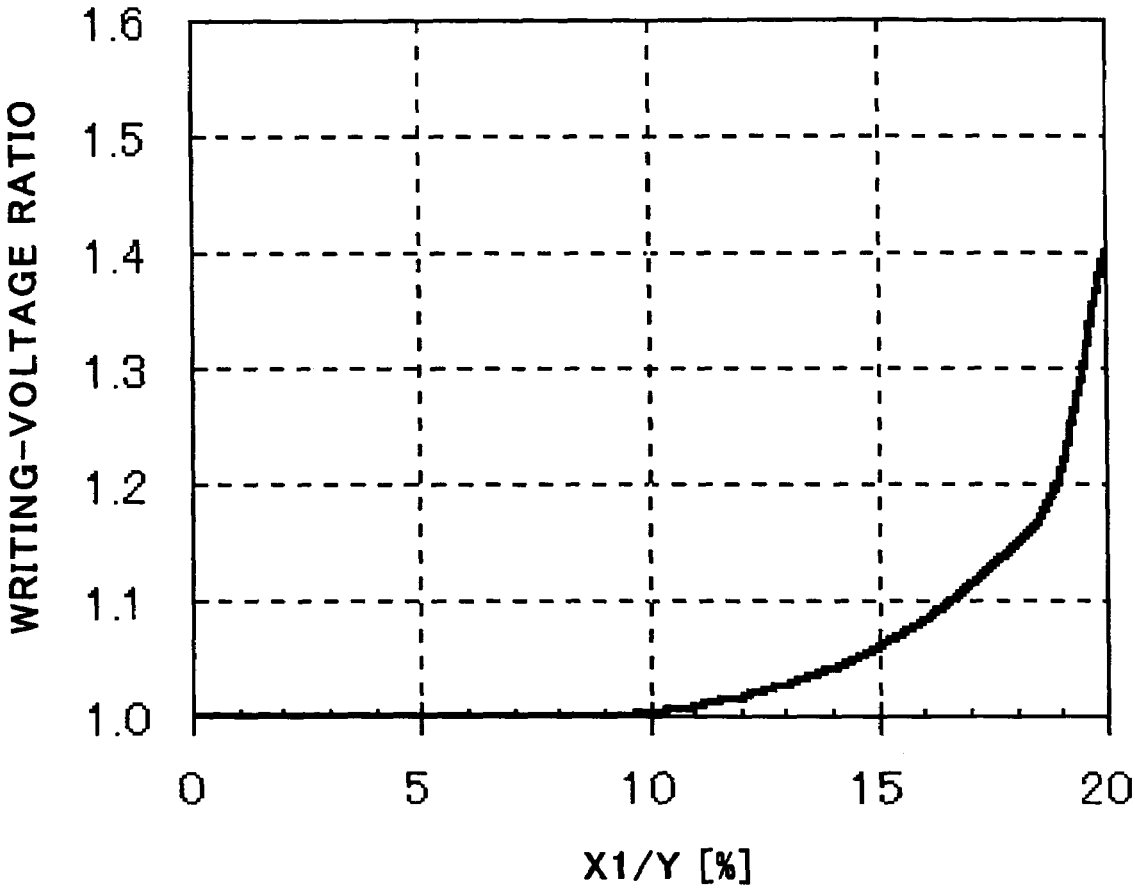
FIG. 9 is a graph showing a relation between a writing-voltage ratio and a ratio defined as X1/Y in the fluorescent material from which blue light emits, in accordance with the second embodiment of the present invention, wherein X1 indicates a number of particles having a diameter equal to or smaller than 1.0 micrometers, and Y indicates a total number of particles contained in the fluorescent material.

FIG. 9 is a graph showing a relation between a writing-voltage ratio and a ratio defined as X1/Y [%] in the fluorescent material in accordance with the second embodiment of the present invention, wherein X1 indicates a number of particles having a diameter equal to or smaller than 1.0 micrometers, and Y indicates a total number of particles contained in the fluorescent material.

A writing-voltage ratio is defined in accordance with the above-mentioned equation (A).

As illustrated in FIG. 9, a writing-voltage ratio is equal to 1.0 when the ratio X1/Y is equal to or smaller than 10%. That is, there is no variance in an actual writing-voltage. In contrast, when the ratio X1/Y becomes over about 11%, a writing-voltage ratio starts increasing. That is, variance begins to occur in an actual writing-voltage. For instance, when the ratio X1/Y is equal to 20%, a writing-voltage ratio rises up to 1.4.

Accordingly, if the ratio X1/Y is equal to or smaller than 10% which is smaller than 11%, there occurs no variance in an actual writing-voltage.

Hence, the fluorescent material from which blue light emits, in accordance with the second embodiment, is designed to have the ratio X1/Y equal to or smaller than 10%, similarly to the fluorescent material in accordance with the first embodiment.

Furthermore, as is obvious in view of FIG. 9, if the ratio X1/Y is equal to or smaller than 1%, there is absolutely no variance in an actual writing-voltage. Accordingly, it is possible to completely prevent variance in an actual writing-voltage by designing the ratio X1/Y to be equal to or smaller than 1% in the fluorescent material in accordance with the second embodiment, similarly to the fluorescent material in accordance with the first embodiment.

Figure 10:
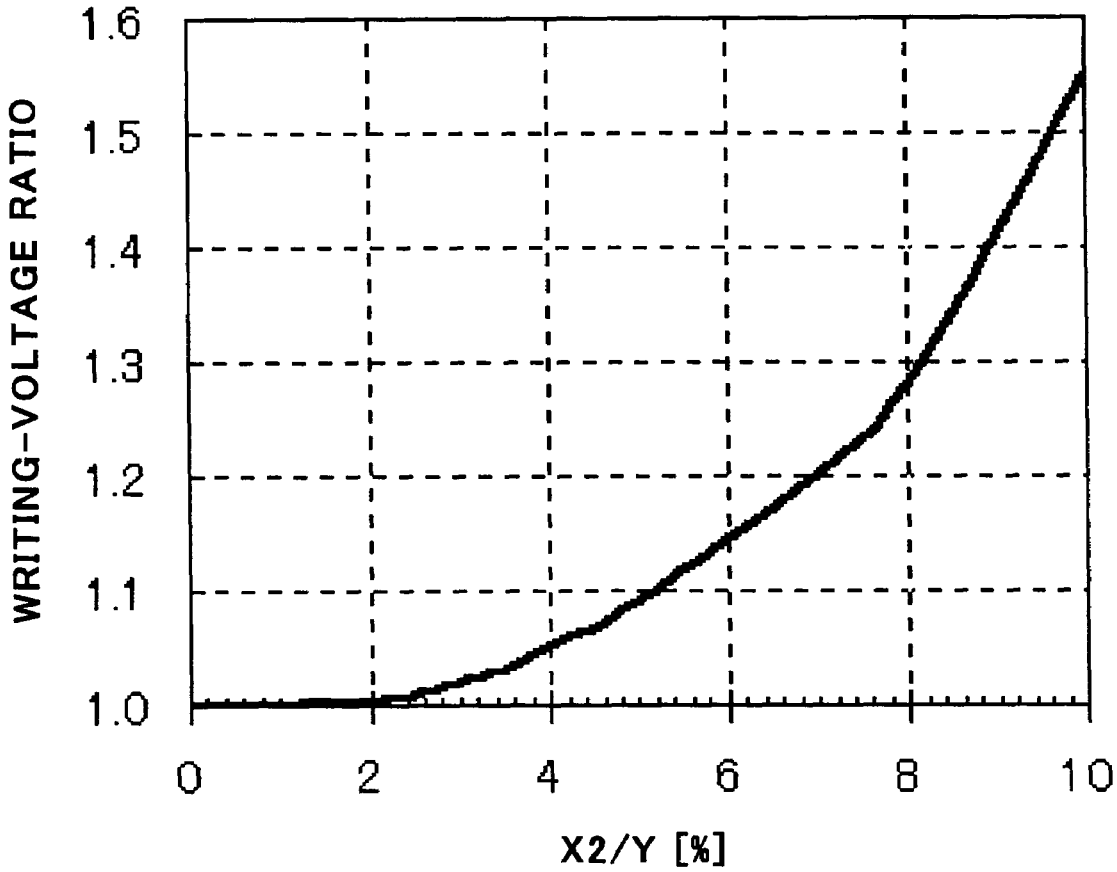
FIG. 10 is a graph showing a relation between a writing-voltage ratio and a ratio defined as X2/Y in the fluorescent material from which blue light emits, in accordance with the second embodiment of the present invention, wherein X2 indicates a number of particles having a diameter equal to or greater than 16.0 micrometers, and Y indicates a total number of particles contained in the fluorescent material.

FIG. 10 is a graph showing a relation between a writing-voltage ratio and a ratio defined as X2/Y in the fluorescent material in accordance with the second embodiment, wherein X2 indicates a number of particles having a diameter equal to or greater than 16.0 micrometers, and Y indicates a total number of particles contained in the fluorescent material.

A writing-voltage ratio is defined in accordance with the above-mentioned equation (A).

As illustrated in FIG. 10, a writing-voltage ratio is equal to 1.0 when the ratio X2/Y is equal to or smaller than 2.0%. That is, there is no variance in an actual writing-voltage. In contrast, when the ratio X2/Y becomes over about 2.2%, a writing-voltage ratio starts rising. That is, variance begins to occur in an actual writing-voltage. For instance, when the ratio X1/Y is equal to 10%, a writing-voltage ratio rises up to 1.55.

Accordingly, if the ratio X2/Y is equal to or smaller than 2% which is smaller than 2.2%, there occurs no variance in an actual writing-voltage.

Hence, the fluorescent material from which blue light emits, in accordance with the second embodiment, is designed to have the ratio X2/Y equal to or smaller than 2%, similarly to the fluorescent material in accordance with the first embodiment.

Furthermore, as is obvious in view of FIG. 10, if the ratio X2/Y is equal to or smaller than 1%, there is absolutely no variance in an actual writing-voltage. Accordingly, it is possible to completely prevent variance in an actual writing-voltage by designing the ratio X2/Y to be equal to or smaller than 1% in the fluorescent material in accordance with the second embodiment, similarly to the fluorescent material in accordance with the first embodiment.

Though not illustrated, the fluorescent material from which blue light emits, in accordance with the second embodiment, is designed to have the ratio T1/T2 equal to or smaller than 1.7, similarly to the fluorescent material in accordance with the first embodiment, wherein T1 indicates a locally maximum thickness of the fluorescent material, and T2 indicates an average thickness of the fluorescent material. Thus, even if there occurs variance in an actual writing-voltage, it is possible to suppress the variance within a quite small range.

Furthermore, it is possible to completely prevent variance in an actual writing-voltage by designing the ratio T1/T2 to be equal to or smaller than 1.5 in the fluorescent material in accordance with the second embodiment, similarly to the fluorescent material in accordance with the first embodiment.

As mentioned above, the fluorescent material from which blue light emits, in accordance with the second embodiment, is designed to have (a) the X1/Y ratio equal to or smaller than 10%, preferably, 1%, (b) the X2/Y ratio equal to or smaller than 2%, preferably, 1%, and (c) the T1/T2 ratio equal to or smaller than 1.7, preferably, 1.5.

As a result, it is possible to prevent variance in an actual writing-voltage relative to an average writing-voltage, and hence, prevent local increase in a voltage necessary for generating writing-discharges. Thus, it is possible to prevent deterioration in quality in displaying images in a plasma display apparatus including the fluorescent material in accordance with the second embodiment.

[Third Embodiment]

The fluorescent material in accordance with the third embodiment emits red light.

As fluorescent material which emits blue light, there may be selected (Y, Gd)$BO_3$:Eu, $Y_2$ $O_3$:Eu or $YPVO_4$:Eu, for instance.

Figure 11:
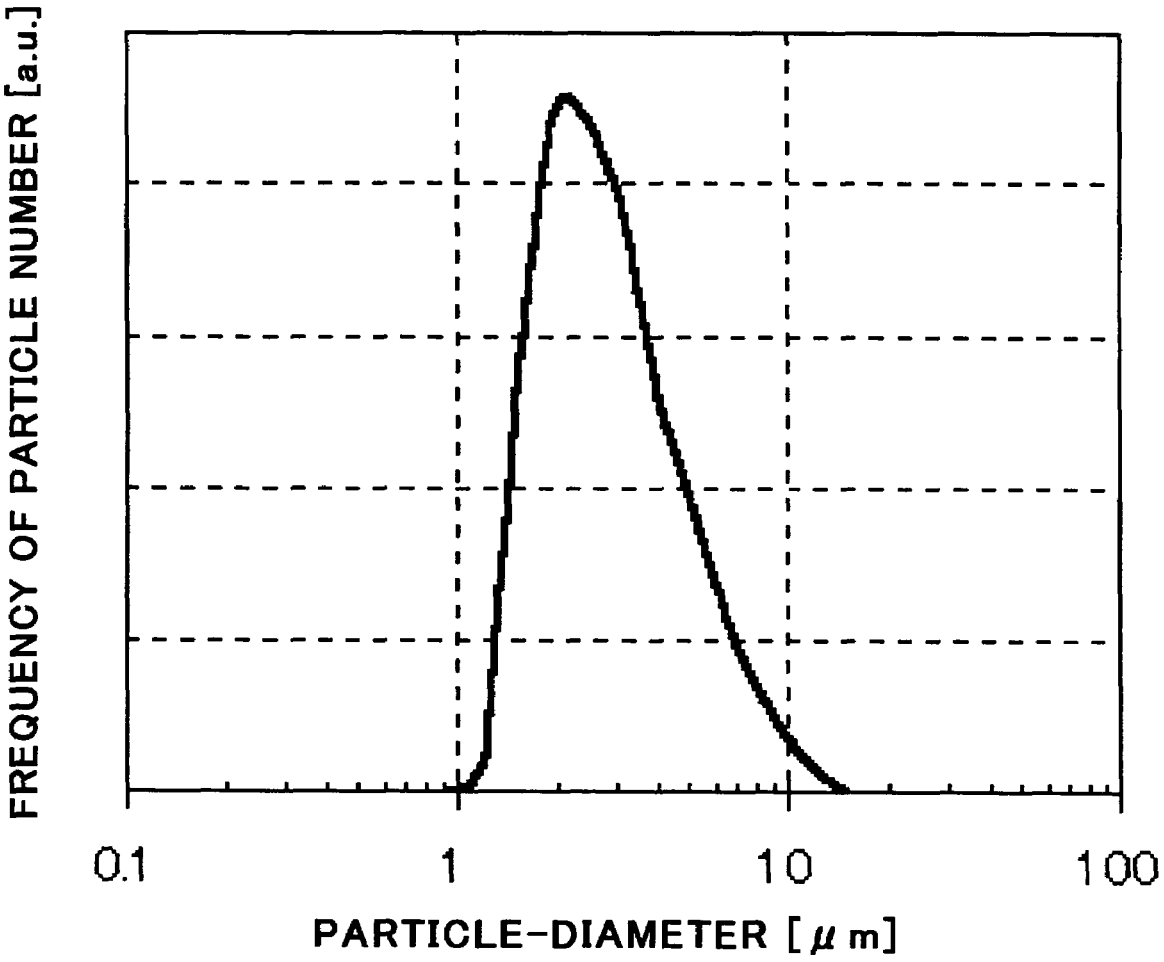
FIG. 11 is a histogram showing a particle-diameter profile of the fluorescent material from which red light emits, in accordance with the third embodiment of the present invention.
Figure 12:
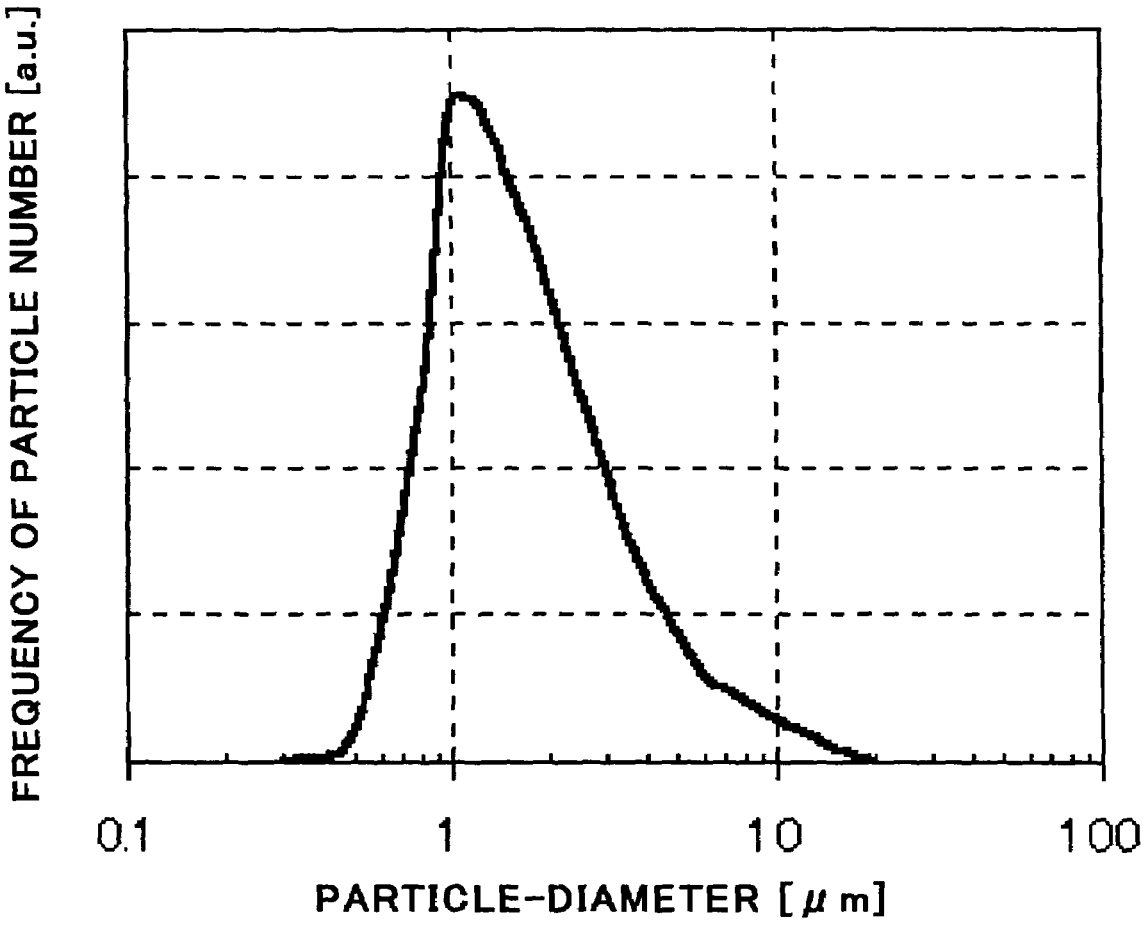
FIG.12 PRIOR ART
FIG. 12 is a histogram showing a particle-diameter profile of conventional fluorescent material from which red light emits.

FIG. 11 is a histogram showing a particle-diameter profile of the fluorescent material in accordance with the third embodiment of the present invention, and FIG. 12 is a histogram showing a particle-diameter profile of conventional fluorescent material from which red light emits. In FIGS. 11 and 12, the axis of abscissa indicates a particle diameter in a unit of micrometer [μg m], and the axis of ordinates indicates a frequency of a number of particles in an arbitrary unit [a.u.].

As is obvious in comparison of FIGS. 11 and 12 with each other, a particle-diameter profile of the fluorescent material in accordance with the third embodiment is narrower than the same of conventional fluorescent material.

Figure 13:
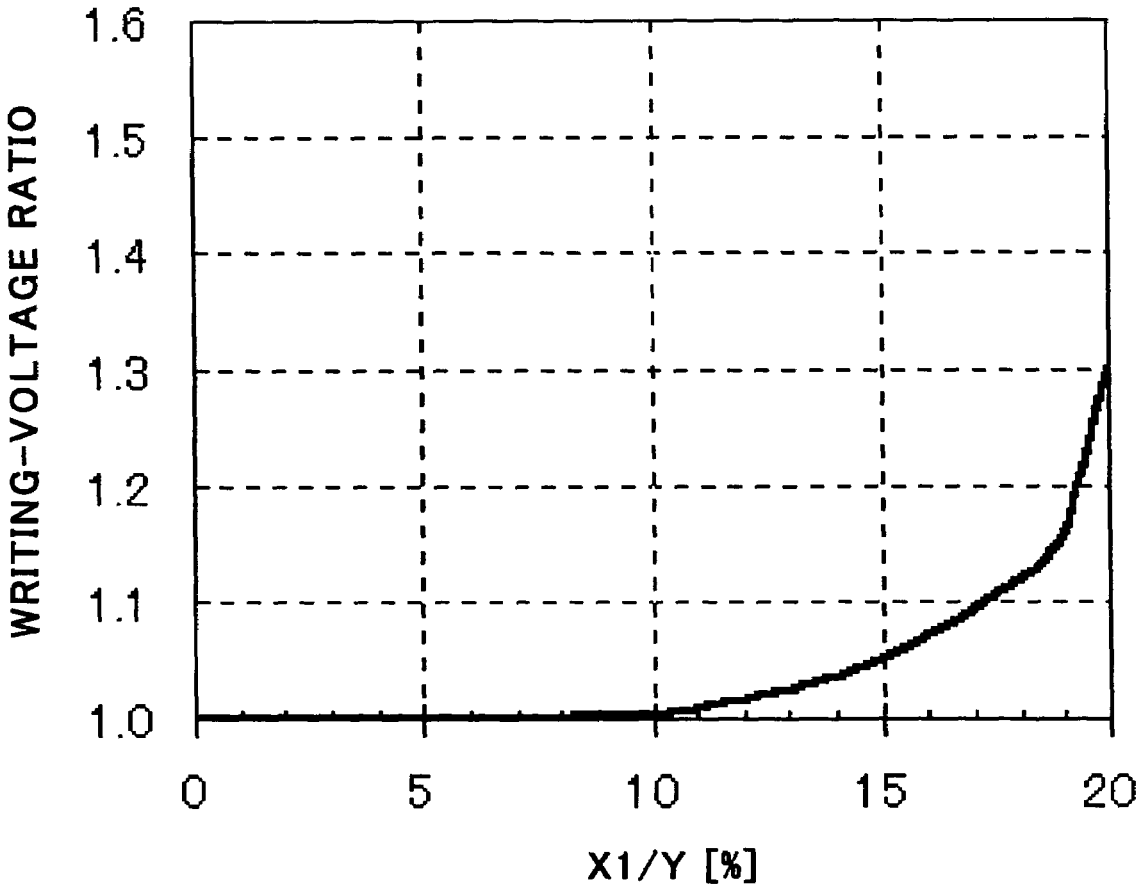
FIG. 13 is a graph showing a relation between a writing-voltage ratio and a ratio defined as X1/Y in the fluorescent material from which red light emits, in accordance with the third embodiment of the present invention, wherein X1 indicates a number of particles having a diameter equal to or smaller than 1.0 micrometers, and Y indicates a total number of particles contained in the fluorescent material.

FIG. 13 is a graph showing a relation between a writing-voltage ratio and a ratio defined as X1/Y [%] in the fluorescent material in accordance with the third embodiment of the present invention, wherein X1 indicates a number of particles having a diameter equal to or smaller than 1.0 micrometers, and Y indicates a total number of particles contained in the fluorescent material.

A writing-voltage ratio is defined in accordance with the above-mentioned equation (A).

As illustrated in FIG. 13, a writing-voltage ratio is equal to 1.0 when the ratio X1/Y is equal to or smaller than 10%. That is, there is no variance in an actual writing-voltage. In contrast, when the ratio X1/Y becomes over about 11%, a writing-voltage ratio starts increasing. That is, variance begins to occur in an actual writing-voltage. For instance, when the ratio X1/Y is equal to 20%, a writing-voltage ratio rises up to 1.3.

Accordingly, if the ratio X1/Y is equal to or smaller than 10% which is smaller than 11%, there occurs no variance in an actual writing-voltage.

Hence, the fluorescent material from which red light emits, in accordance with the third embodiment, is designed to have the ratio X1/Y equal to or smaller than 10%, similarly to the fluorescent materials in accordance with the first and second embodiments.

Furthermore, as is obvious in view of FIG. 13, if the ratio X1/Y is equal to or smaller than 1%, there is absolutely no variance in an actual writing-voltage. Accordingly, it is possible to completely prevent variance in an actual writing-voltage by designing the ratio X1/Y to be equal to or smaller than 1% in the fluorescent material in accordance with the third embodiment, similarly to the fluorescent materials in accordance with the first and second embodiments.

Figure 14:
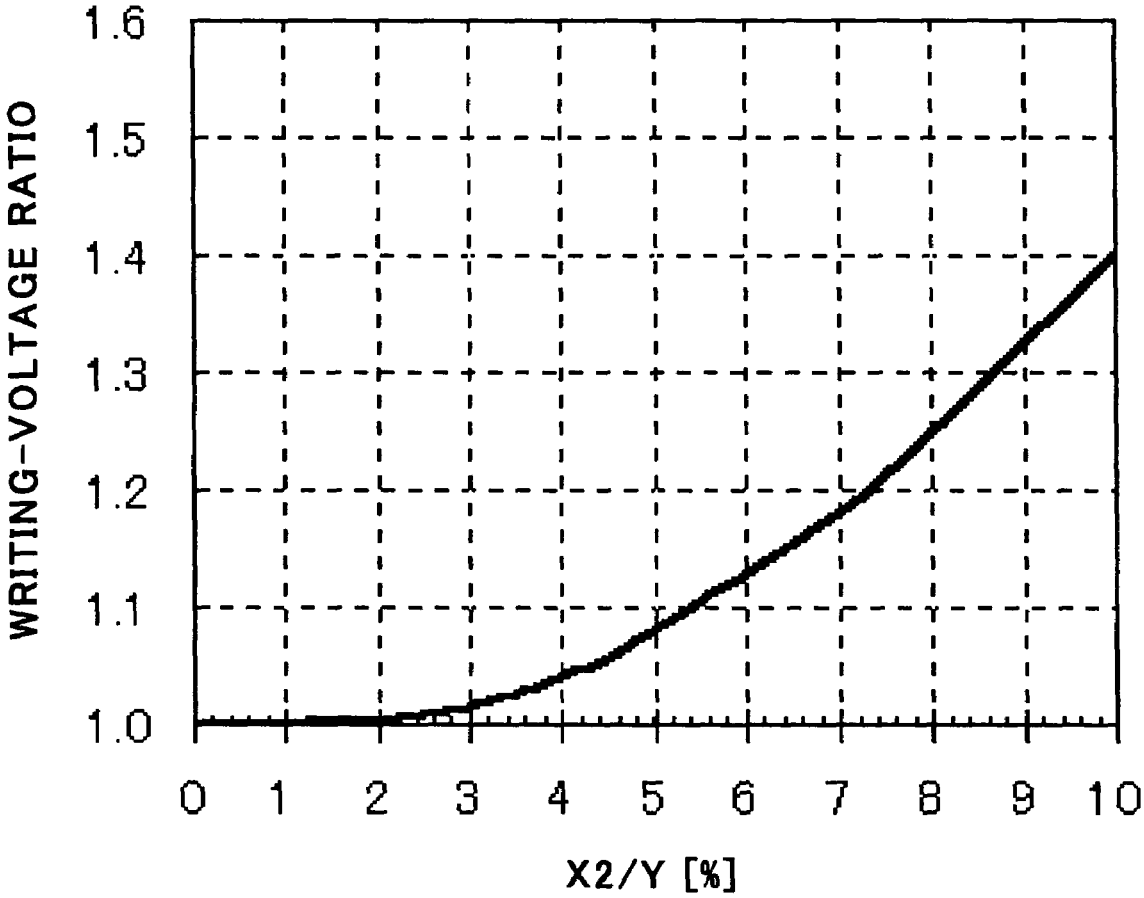
FIG. 14 is a graph showing a relation between a writing-voltage ratio and a ratio defined as X2/Y in the fluorescent material from which red light emits, in accordance with the third embodiment of the present invention, wherein X2 indicates a number of particles having a diameter equal to or greater than 16.0 micrometers, and Y indicates a total number of particles contained in the fluorescent material.

FIG. 14 is a graph showing a relation between a writing-voltage ratio and a ratio defined as X2/Y in the fluorescent material in accordance with the third embodiment, wherein X2 indicates a number of particles having a diameter equal to or greater than 16.0 micrometers, and Y indicates a total number of particles contained in the fluorescent material.

A writing-voltage ratio is defined in accordance with the above-mentioned equation (A).

As illustrated in FIG. 14, a writing-voltage ratio is equal to 1.0 when the ratio X2/Y is equal to or smaller than 2.0%. That is, there is no variance in an actual writing-voltage. In contrast, when the ratio X2/Y becomes over about 2.2%, a writing-voltage ratio starts rising. That is, variance begins to occur in an actual writing-voltage. For instance, when the ratio X1/Y is equal to 10%, a writing-voltage ratio rises up to 1.4.

Accordingly, if the ratio X2/Y is equal to or smaller than 2% which is smaller than 2.2%, there occurs no variance in an actual writing-voltage.

Hence, the fluorescent material from which red light emits, in accordance with the third embodiment, is designed to have the ratio X2/Y equal to or smaller than 2%, similarly to the fluorescent materials in accordance with the first and second embodiments.

Furthermore, as is obvious in view of FIG. 14, if the ratio X2/Y is equal to or smaller than 1%, there is absolutely no variance in an actual writing-voltage. Accordingly, it is possible to completely prevent variance in an actual writing-voltage by designing the ratio X2/Y to be equal to or smaller than 1% in the fluorescent material in accordance with the third embodiment, similarly to the fluorescent materials in accordance with the first and second embodiments.

Though not illustrated, the fluorescent material from which red light emits, in accordance with the third embodiment, is designed to have the ratio T1/T2 equal to or smaller than 1.7, similarly to the fluorescent materials in accordance with the first and second embodiments, wherein T1 indicates a locally maximum thickness of the fluorescent material, and T2 indicates an average thickness of the fluorescent material. Thus, even if there occurs variance in an actual writing-voltage, it is possible to suppress the variance within a quite small range.

Furthermore, it is possible to completely prevent variance in an actual writing-voltage by designing the ratio T1/T2 to be equal to or smaller than 1.5 in the fluorescent material in accordance with the third embodiment, similarly to the fluorescent materials in accordance with the first and second embodiments.

As mentioned above, the fluorescent material from which red light emits, in accordance with the third embodiment, is designed to have (a) the X1/Y ratio equal to or smaller than 10%, preferably, 1%, (b) the X2/Y ratio equal to or smaller than 2%, preferably, 1%, and (c) the T1/T2 ratio equal to or smaller than 1.7, preferably, 1.5.

As a result, it is possible to prevent variance in an actual writing-voltage relative to an average writing-voltage, and hence, prevent local increase in a voltage necessary for generating writing-discharges. Thus, it is possible to prevent deterioration in quality in displaying images in a plasma display apparatus including the fluorescent material in accordance with the third embodiment.

[Fourth Embodiment]

The fluorescent materials in accordance with the above-mentioned first to third embodiments are coated on both sidewalls of the partition walls 7 (see FIG. 1) and an exposed surface of the dielectric layer 4B. In contrast, a plasma display panel in accordance with the fourth embodiment is designed to include a light-reflection layer formed on both sidewalls of the partition walls 7 and an exposed surface of the dielectric layer 4B. In the fourth embodiment, fluorescent material is coated onto the light-reflection layer. As fluorescent material to be coated onto the light-reflection layer, there may be selected the fluorescent material in accordance with any one or more of the first to third embodiments.

In general, fluorescent material containing particles having a greater diameter could provide a lower brightness. However, the light-reflection layer prevents reduction in a brightness. Thus, the provision of the light-reflection layer prevents reduction in a brightness, and allows fluorescent material to contain particles having a greater diameter.

It is preferable that the light-reflection layer includes white pigment powder. The light-reflection layer including white pigment therein would have white hue or would be almost white in color, ensuring enhanced reflection-ability.

Figure 1:
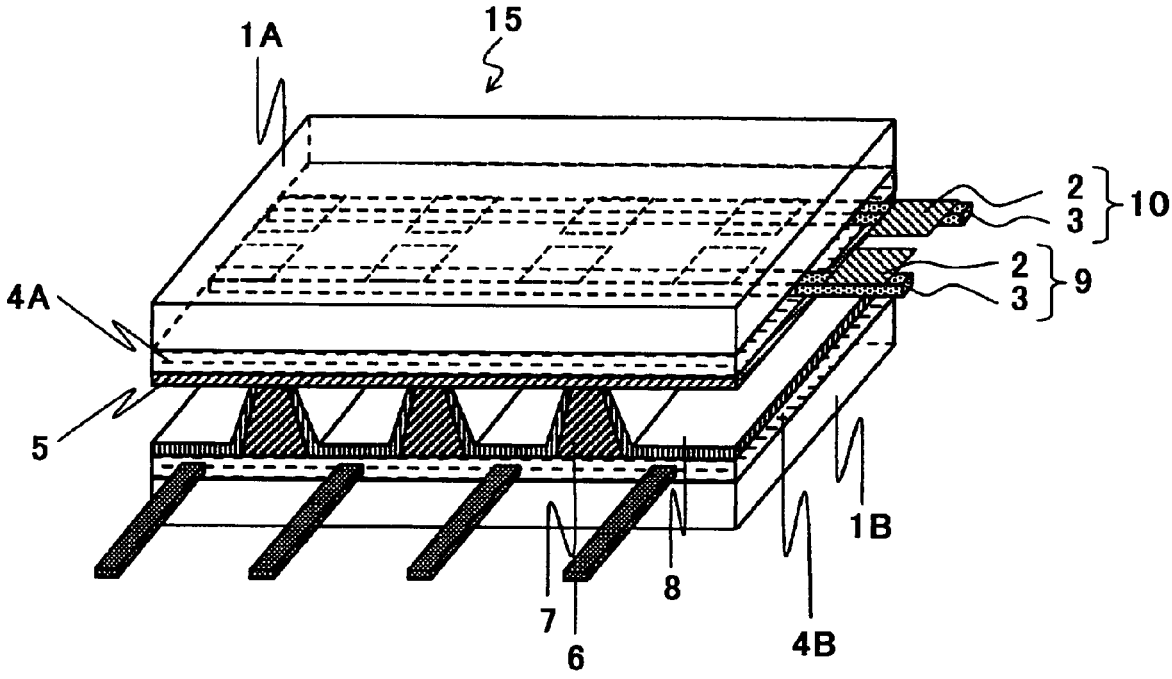
FIG.1 PRIOR ART
FIG. 1 is an exploded perspective view of a conventional plasma display panel.

A method of fabricating the plasma display panel 15 as an example of a plasma display apparatus including the fluorescent materials in accordance with the first to third embodiments is explained hereinbelow with reference to FIG. 1.

First, the scanning electrode 9 and the common electrode 10 are formed on the front substrate 1A. Then, the dielectric layer 4A is formed on the front substrate 1A, covering the scanning electrode 9 and the common electrode 10 therewith. Then, the protection layer 5 is formed on the dielectric layer 4A.

The data electrodes 6 are formed on the rear substrate 1B. Then, the dielectric layer 4B is formed on the rear substrate 1B, covering the data electrodes 6 therewith. Then, the partition walls 7 are formed on the dielectric layer 4B.

Then, the fluorescent materials 8 in accordance with the above-mentioned first to third embodiments are coated onto both sidewalls of the partition walls 7 and an exposed surface of the dielectric layer 4B. The fluorescent materials 8 in accordance with the above-mentioned first to third embodiments are coated one by one in every three cells.

Then, glass-paste adhesive is coated onto edges of the front and rear substrates 1A and 1B through the use of a dispenser and the like for hermetically coupling them to each other. For instance, the adhesive is comprised of a mixture of glass frit having a low melting point, binder and organic solvent having a low boiling point.

Then, the rear substrate 1B is heated for solidifying the adhesive.

Then, a vent pipe is attached to the rear substrate 1B in alignment with an opening (not illustrated) formed at the rear substrate 1B. A tube is connected to the vent pipe. Then, the discharge gas space is evacuated through the tube. The front and rear substrates 1A and 1B are heated with the discharge gas space being kept vacuous for discharging unnecessary molecules such as moisture residual in the discharge gas space.

Then, the front and rear substrates 1A and 1B are cooled. After filling the discharge gas space with discharge gas, the vent pipe is cut.

Thus, there is completed the plasma display panel 15.

Hereinbelow are explained examples of the fluorescent material in accordance with the present invention, having been made by the inventors.

EXAMPLE 1

As Example 1, there was synthesized fluorescent material $Zn_2SiO_4$:Mn from which green light emits. In the fluorescent material, the ratio X1/Y was equal to 0.5%, and a maximum particle-diameter was 13 micrometers.

Then, solvent containing, as a principal constituent, BCA including ethylcellulose and other resins was mixed to the fluorescent material to thereby prepare fluorescent material paste. Then, the fluorescent material paste was coated onto sidewalls of the partition walls 7 and an exposed surface of the dielectric layer 4B by screen-printing. Thereafter, the fluorescent material paste was dried and baked, and thus, there was formed the fluorescent layer having a thickness of 10 micrometers.

The resultant fluorescent layer had the ratio X1/Y equal to or smaller than 1%. Accordingly, an increase in a voltage necessary for generating a writing-discharge, caused by aggregation of minute particles, was not observed.

Furthermore, since the maximum particle-diameter was 13 micrometers, the ratio T1/T2 was calculated to be 1.3 (13/10=1.3), which is smaller than 1.7. Accordingly, an increase in a voltage necessary for generating a writing-discharge was not observed.

Apart from the above-mentioned fluorescent layer, there was also synthesized fluorescent layer from which green light emits, composed of (Y, Gd)$BO_3$:Tb in place of $Zn_2SiO_4$:Mn, and having a thickness of 10 micrometers. With respect to the fluorescent layer, an increase in a voltage necessary for generating a writing-discharge was not observed.

There was also synthesized fluorescent layer from which green light emits, composed of $YBO_3$:Tb in place of $Zn_2SiO_4$:Mn, and having a thickness of 10 micrometers. With respect to the fluorescent layer, an increase in a voltage necessary for generating a writing-discharge was not observed.

EXAMPLE 2

As Example 2, there was synthesized fluorescent material (Y, Gd)$BO_3$:Eu from which red light emits. Then, the fluorescent layer composed of (Y, Gd)$BO_3$:Eu and having a thickness of 10 micrometers was made in the same was as Example 1.

With respect to the fluorescent layer of Example 2, an increase in a voltage necessary for generating a writing-discharge was not observed, similarly to Example 1.

Apart from the above-mentioned fluorescent layer, there was also synthesized fluorescent layer from which red light emits, composed of ($Y_2O_3$:Eu) in place of (Y, Gd)$BO_3$:Eu, and having a thickness of 10 micrometers. With respect to the fluorescent layer, an increase in a voltage necessary for generating a writing-discharge was not observed.

There was also synthesized fluorescent layer from which red light emits, composed of $YPVO_4$:Eu in place of (Y, Gd)$BO_3$:Eu, and having a thickness of 10 micrometers. With respect to the fluorescent layer, an increase in a voltage necessary for generating a writing-discharge was not observed.

EXAMPLE 3

As Example 3, there was synthesized fluorescent material $BaMgAl_{10}O_{17}$:Eu from which blue light emits. Then, the fluorescent layer composed of $BaMgAl_{10}O_{17}$:Eu and having a thickness of 10 micrometers was made in the same was as Example 1.

With respect to the fluorescent layer of Example 3, an increase in a voltage necessary for generating a writing-discharge was not observed, similarly to Example 1.

EXAMPLE 4

As Example 4, there was synthesized fluorescent material $Zn_2SiO_4$:Mn from which green light emits. In the fluorescent material, the ratio X1/Y was equal to 0.5%, and a maximum particle-diameter was 13 micrometers.

Then, solvent containing, as a principal constituent, BCA including ethylcellulose and other resins was mixed to the fluorescent material to thereby prepare fluorescent material paste. Then, the fluorescent material paste was coated onto sidewalls of the partition walls 7 and an exposed surface of the dielectric layer 4B by screen-printing. Thereafter, the fluorescent material paste was dried and baked, and thus, there was formed the fluorescent layer having a thickness of 20 micrometers.

The resultant fluorescent layer had the ratio X1/Y equal to or smaller than 1%. Accordingly, an increase in a voltage necessary for generating a writing-discharge, caused by aggregation of minute particles, was not observed.

Furthermore, since the maximum particle-diameter was 13 micrometers, the ratio T1/T2 was calculated to be 0.65 (13/20=0.65), which is smaller than 1.7. Accordingly, an increase in a voltage necessary for generating a writing-discharge was not observed.

EXAMPLE 5

As Example 5, there was synthesized fluorescent material (Y, Gd)$BO_3$:Eu from which red light emits. Then, the fluorescent layer composed of (Y, Gd)$BO_3$:Eu and having a thickness of 20 micrometers was made in the same was as Example 4.

With respect to the fluorescent layer of Example 5, an increase in a voltage necessary for generating a writing-discharge was not observed, similarly to Example 4.

Apart from the above-mentioned fluorescent layer, there was also synthesized fluorescent layer from which red light emits, composed of ($Y_2O_3$:Eu) in place of (Y, Gd)$BO_3$:Eu, and having a thickness of 20 micrometers. With respect to the fluorescent layer, an increase in a voltage necessary for generating a writing-discharge was not observed.

There was also synthesized fluorescent layer from which red light emits, composed of $YPVO_4$:Eu in place of (Y, Gd)$BO_3$:Eu, and having a thickness of 20 micrometers. With respect to the fluorescent layer, an increase in a voltage necessary for generating a writing-discharge was not observed.

EXAMPLE 6

As Example 6, there was synthesized fluorescent material $BaMgAl_{10}O_{17}$:Eu from which blue light emits. Then, the fluorescent layer composed of $BaMgAl_{10}O_{17}$:Eu and having a thickness of 20 micrometers was made in the same was as Example 4.

With respect to the fluorescent layer of Example 6, an increase in a voltage necessary for generating a writing-discharge was not observed, similarly to Example 4.

[Fifth Embodiment]

Figure 15:
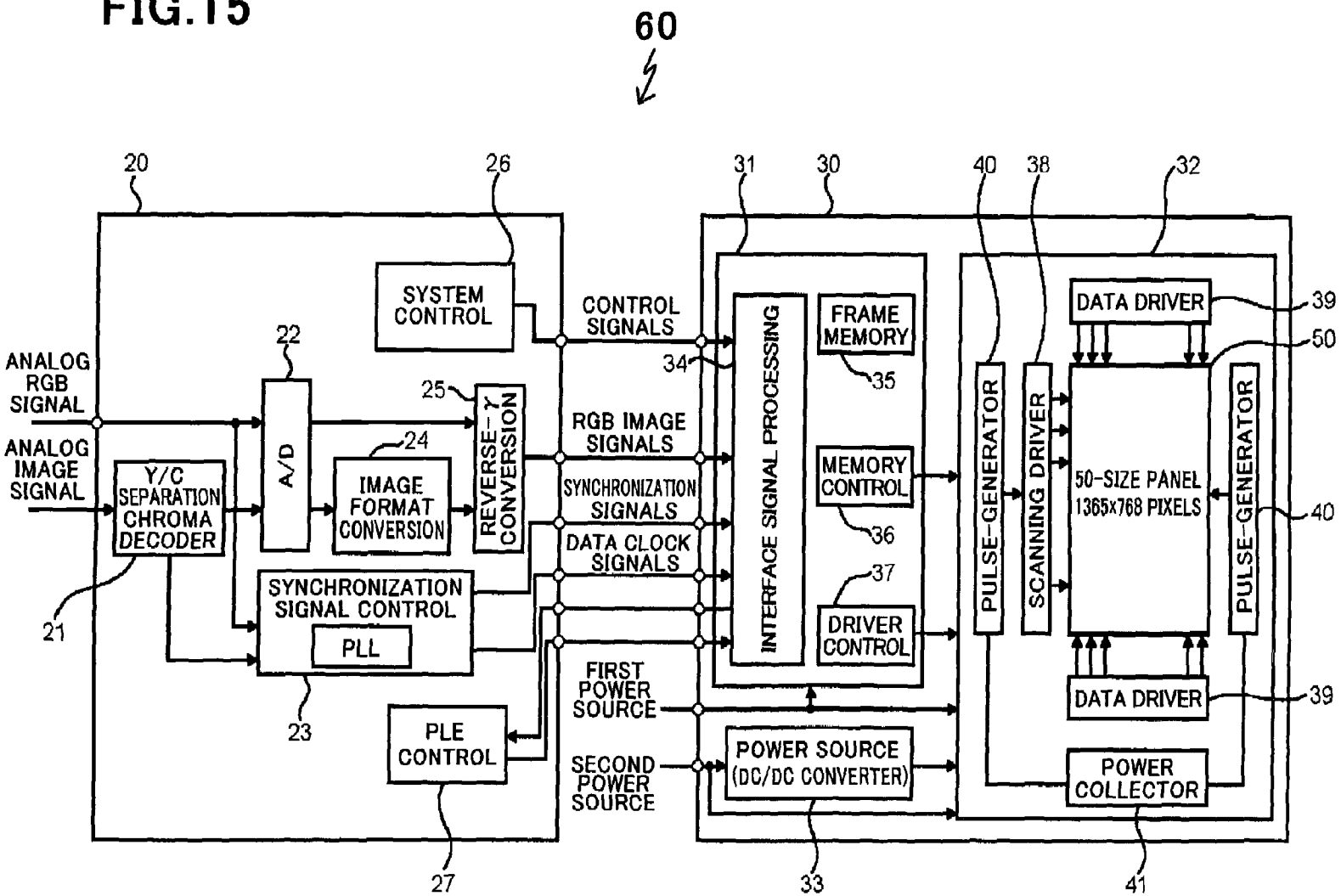
FIG. 15 is a block diagram of a plasma display apparatus including the plasma display panel including the fluorescent material in accordance with one of the first to third embodiments.

FIG. 15 is a block diagram of a plasma display apparatus 60 including a plasma display panel including the fluorescent materials in accordance with the above-mentioned first to third embodiments.

As illustrated in FIG. 15, the plasma display apparatus 60 has a modularized structure. Specifically, the plasma display apparatus 60 is comprised of an analog interface 20 and a plasma display module 30.

The analog interface 20 is comprised of a Y/C separating circuit 21 including a chroma-decoder, an analog-digital (A/D) converting circuit 22, a circuit 23 for controlling a synchronization signal, including a phase-lock loop (PLL) circuit, a circuit 24 for converting an image format, an reverse-gamma converting circuit 25, a system control circuit 26, and a PLE control circuit 27.

In brief, the analog interface 20 coverts a received analog image signal into a digital image signal, and then, outputs the digital image signal to the plasma display module 30.

For instance, an analog image signal transmitted from a television tuner (not illustrated) is separated into luminance signals for RGB colors in the Y/C separating circuit 21, and then, converted into a digital signal in the A/D converting circuit 22.

Then, if a pixel configuration in the plasma display module 30 is different from a pixel configuration of the image signal, necessary conversion is carried out in the image-format converting circuit 24.

A characteristic of a luminance to a signal input to a plasma display panel is linear. Image signals are usually compensated for, specifically, gamma-converted in advance in accordance with characteristics of a cathode ray tube (CRT). Hence, after the image, signals are A/D-converted in the A/D converting circuit 22, reverse-gamma conversion is applied to the image signals are in the reverse-gamma converting circuit 25 for producing digital image signals having linear characteristics. The digital image signals are output to the plasma display module 30 as RGB image signals.

Since an analog image signal does not include a sampling clock signal and a data clock signal used for A/D conversion, the PLL circuit included in the control circuit 23 produces a sampling clock signal and a data clock signal, based on a horizontal synchronization signal provided together with the analog image signal, and outputs the clock signals to the plasma display module 30.

The PLE control circuit 27 carries out luminance control. Specifically, if an average picture level is equal to or smaller than a threshold level, a luminance for displayed images is raised, and if an average picture level is greater than a threshold level, a luminance is reduced.

The system control circuit 26 outputs various control signals to the plasma display module 30.

The plasma display module 30 is comprised of a digital signal processing and controlling circuit 31, a panel section 32, and a power source circuit 33 including a DC/DC converter.

The digital signal processing and controlling circuit 31 is comprised of an interface signal processing circuit 34, a frame memory 35, a memory control circuit 36, and a driver control circuit 37.

The interface signal processing circuit 34 receives various control signals transmitted from the system control circuit 26, an RGB image signal transmitted from the reverse-gamma converting circuit 25, a synchronization signal transmitted from the control circuit 23, and a data clock signal transmitted from the PLL circuit.

For instance, an average picture level (APL) of an image signal input into the interface signal processing circuit 34 is calculated in an APL calculating circuit (not illustrated) included in the interface signal processing circuit 34, and output as 5-bit data, for instance. The PLE control circuit 27 arranges PLE control data in accordance with the calculated average picture level, and outputs the PLE control data to a picture level control circuit (not illustrated) included in the interface signal processing circuit 34.

The digital signal processing and controlling circuit 31 processes those signals in the interface signal processing circuit 34, and then, transmits a control signal to the panel section 32. The memory control circuit 36 transmits a memory control signal to the panel section 32, and the driver control circuit 37 transmits a driver control signal to the panel section 32.

The panel section 32 is comprised of a 50-size plasma display panel 50, a scanning driver 38 for driving a scanning electrode, data drivers 39 for driving data electrodes, pulse-generating circuits 40 for applying a pulse voltage to the plasma display panel 50 and the scanning driver 38, and a circuit 41 for collecting excess power from the pulse-generating circuits 40.

The plasma display panel 50 is designed to have 1365×768 pixels. In the plasma display panel 50, the scanning driver 38 controls a scanning electrode, and the data drivers 39 control data electrodes, thereby a light is emitted from selected display cells for displaying images.

A first power source supplies power to the digital signal processing and controlling circuit 31 and the panel section 32. A power source circuit 33 receives DC power from a second power source, converts a DC voltage into a desired voltage, and supplies the desired voltage to the panel section 32.

Hereinbelow is explained a method of fabricating the plasma display apparatus 60.

First, the plasma display panel 50, the scanning driver 38, the data drivers 39, the pulse-generating circuits 40, and the power-collecting circuit 41 are arranged on a substrate to thereby fabricate the panel section 32.

Apart from the panel section 32, there is fabricated the digital signal processing and controlling circuit 31.

The panel section 32, the digital signal processing and controlling circuit 31 and the power source circuit 33 are assembled as a module. Thus, the plasma display module 30 is completed.

Apart from the plasma display module 30, there is fabricated the analog interface 20.

After the plasma display module 30 and the analog interface 20 have been fabricated separately from each other, they are electrically connected to each other. Thus, there is completed the plasma display apparatus 60 illustrated in FIG. 15.

By modularizing the plasma display apparatus 60, the plasma display panel 50 can be fabricated independently of other parts constituting the plasma display apparatus 60. For instance, if the plasma display panel 50 went wrong in the plasma display apparatus 60, the plasma display module 30 including the plasma display panel 50 having gone wrong can be exchanged into new one, ensuring simplification in repair and reduction in time for repair.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2003-167955 filed on Jun. 12, 2003 including specification, claims, drawings and summary is incorporated herein by reference in its entirety.

What is claimed is:

1. A fluorescent material used for a plasma display panel, said fluorescent material containing particles having various diameters wherein X1/Y is equal to or smaller than 10% where X1 indicates a number of particles having a diameter equal to or smaller than 1.0 micrometers, and Y indicates a total number of particles contained in said fluorescent material, and that X2/Y is equal to or smaller than 2% where X2 indicates a number of particles having a diameter equal to or greater than 16 micrometers.

2. A fluorescent material used for a plasma display panel, said fluorescent material containing particles having various diameters wherein X1/Y is equal to or smaller than 10% where X1 indicates a number of particles having a diameter equal to or smaller than 1.0 micrometers, and Y indicates a total number of particles contained in said fluorescent material, and that X2/Y is equal to or smaller than 1% where X2 indicates a number of particles having a diameter equal to or greater than 16 micrometers.

3. A fluorescent material used for a plasma display panel, said fluorescent material containing particles having various diameters wherein X1/Y is equal to or smaller than 10% where X1 indicates a number of particles having a diameter equal to or smaller than 1.0 micrometers, and Y indicates a total number of particles contained in said fluorescent material, and that T1/T2 is equal to or smaller than 1.7 where T1 indicates a locally maximum thickness of said fluorescent material, and T2 indicates an average thickness of said fluorescent material.

4. A fluorescent material used for a plasma display panel, said fluorescent material containing particles having various diameters wherein X1/Y is equal to or smaller than 10% where X1 indicates a number of particles having a diameter equal to or smaller than 1.0 micrometers, and Y indicates a total number of particles contained in said fluorescent material, and that T1/T2 is equal to or smaller than 1.5 where T1 indicates a locally maximum thickness of said fluorescent material, and T2 indicates an average thickness of said fluorescent material.

5. Fluorescent material used for a plasma display panel, said fluorescent material containing particles having various diameters wherein X1/Y is equal to or smaller than 1% where X1 indicates a number of particles having a diameter equal to or smaller than 1.0 micrometers, and Y indicates a total number of particles contained in said fluorescent material.

6. The fluorescent material as set forth in claim 5, wherein X2/Y is equal to or smaller than 2% where X2 indicates a number of particles having a diameter equal to or greater than 16 micrometers.

7. The fluorescent material as set forth in claim 5, wherein X2/Y is equal to or smaller than 1% where X2 indicates a number of particles having a diameter equal to or greater than 16 micrometers.

8. The fluorescent material as set forth in claim 5, wherein T1/T2 is equal to or smaller than 1.7 where T1 indicates a locally maximum thickness of said fluorescent material, and T2 indicates an average thickness of said fluorescent material.

9. The fluorescent material as set forth in claim 5, wherein T1/T2 is equal to or smaller than 1.5 where T1 indicates a locally maximum thickness of said fluorescent material, and T2 indicates an average thickness of said fluorescent material.

10. A plasma display apparatus comprising a first substrate, a second substrate and fluorescent material arranged between said first and second substrates, wherein electric discharge is caused in a discharge cell formed between said first and second substrates to excite said fluorescent material to emit a light, said fluorescent material containing particles having various diameters wherein X1/Y is equal to or smaller than 10% where X1 indicates a number of particles having a diameter equal to or smaller than 1.0 micrometers, and Y indicates a total number of particles contained in said fluorescent material, and that X2/Y is equal to or smaller than 2% where X2 indicates a number of particles having a diameter equal to or greater than 16 micrometers.

11. A plasma display apparatus comprising a first substrate, a second substrate and fluorescent material arranged between said first and second substrates, wherein electric discharge is caused in a discharge cell formed between said first and second substrates to excite said fluorescent material to emit a light, said fluorescent material containing particles having various diameters wherein X1/Y is equal to or smaller than 10% where X1 indicates a number of particles having a diameter equal to or smaller than 1.0 micrometers, and Y indicates a total number of particles contained in said fluorescent material, and that X2/Y is equal to or smaller than 1% where X2 indicates a number of particles having a diameter equal to or greater than 16 micrometers.

12. A plasma display apparatus comprising a first substrate, a second substrate and fluorescent material arranged between said first and second substrates, wherein electric discharge is caused in a discharge cell formed between said first and second substrates to excite said fluorescent material to emit a light, said fluorescent material containing particles having various diameters wherein X1/Y is equal to or smaller than 10% where X1 indicates a number of particles having a diameter equal to or smaller than 1.0 micrometers, and Y indicates a total number of particles contained in said fluorescent material, and that T1/T2 is equal to or smaller than 1.7 where T1 indicates a locally maximum thickness of said fluorescent material, and T2 indicates an average thickness of said fluorescent material.

13. A plasma display apparatus comprising a first substrate, a second substrate and fluorescent material arranged between said first and second substrates, wherein electric discharge is caused in a discharge cell formed between said first and second substrates to excite said fluorescent material to emit a light, said fluorescent material containing particles having various diameters wherein X1/Y is equal to or smaller than 10% where X1 indicates a number of particles having a diameter equal to or smaller than 1.0 micrometers, and Y indicates a total number of particles contained in said fluorescent material, and that T1/T2 is equal to or smaller than 1.5 where T1 indicates a locally maximum thickness of said fluorescent material, and T2 indicates an average thickness of said fluorescent material.

14. A plasma display apparatus comprising a first substrate, a second substrate and fluorescent material arranged between said first and second substrates, wherein electric discharge is caused in a discharge cell formed between said first and second substrates to excite said fluorescent material to emit a light, said fluorescent material containing particles having various diameters wherein X1/Y is equal to or smaller than 1% where X1 indicates a number of particles having a diameter equal to or smaller than 1.0 micrometers, and Y indicates a total number of particles contained in said fluorescent material.

15. The plasma display apparatus as set forth in claim 14, wherein X2/Y is equal to or smaller than 2% where X2 indicates a number of particles having a diameter equal to or greater than 16 micrometers.

16. The plasma display apparatus as set forth in claim 14, wherein X2/Y is equal to or smaller than 1% where X2 indicates a number of particles having a diameter equal to or greater than 16 micrometers.

17. The plasma display apparatus as set forth in claim 14, wherein T1/T2 is equal to or smaller than 1.7 where T1 indicates a locally maximum thickness of said fluorescent material, and T2 indicates an average thickness of said fluorescent material.

18. The plasma display apparatus as set forth in claim 14, wherein T1/T2 is equal to or smaller than 1.5 where T1 indicates a locally maximum thickness of said fluorescent material, and T2 indicates an average thickness of said fluorescent material.

* * * * *